US005737172A

United States Patent [19]

Ohtsuka

[11] Patent Number: 5,737,172

[45] Date of Patent: Apr. 7, 1998

[54] ELECTROMAGNETIC CONTACTOR AND A METHOD OF CONTROLLING THE SAME

[75] Inventor: Shigeharu Ohtsuka, Nagoya, Japan

[73] Assignees: Mitsubishi Denki Kabushiki Kaisha; Mitsubishi Electric Engineering Co., Ltd., both of Tokyo, Japan

[21] Appl. No.: 502,666

[22] Filed: Jul. 14, 1995

[30] Foreign Application Priority Data

Jul. 15, 1994 [JP] Japan ..... 6-164015

[51] Int. Cl.[6] ..... H01H 47/04

[52] U.S. Cl. ..... 361/154; 361/187; 307/128

[58] Field of Search ..... 307/128; 361/152–154, 361/160, 185–187, 184, 190

[56] References Cited

U.S. PATENT DOCUMENTS

| | | | |
|---|---|---|---|
| 3,982,505 | 9/1976 | Rivere | 361/154 |
| 4,205,361 | 5/1980 | Shimp | 361/192 |
| 4,516,185 | 5/1985 | Culligan et al. | 361/154 |
| 4,633,362 | 12/1986 | Saunders | 361/152 |
| 4,641,219 | 2/1987 | Aiba | 361/154 |
| 4,812,945 | 3/1989 | D'Onofrio | 361/154 |
| 4,833,565 | 5/1989 | Bauer et al. | 361/154 |
| 4,878,147 | 10/1989 | Oyama et al. | 361/154 |
| 5,008,773 | 4/1991 | Yoshida et al. | 361/187 |
| 5,128,825 | 7/1992 | Hurley et al. | 361/154 |
| 5,375,032 | 12/1994 | Hatakeyama et al. | 361/187 |
| 5,406,440 | 4/1995 | Wieloch | 361/154 |
| 5,471,360 | 11/1995 | Ishikawa et al. | 361/154 |
| 5,546,268 | 8/1996 | Hurley et al. | 361/154 |

FOREIGN PATENT DOCUMENTS

| | | |
|---|---|---|
| 0 532 298 A1 | 3/1993 | European Pat. Off. . |
| 0 567 935 A1 | 11/1993 | European Pat. Off. . |
| 25 13 043 | 10/1976 | Germany . |
| 32 46 739 A1 | 6/1983 | Germany . |
| 41 17 635 A1 | 12/1992 | Germany . |
| 59-47714 | 3/1984 | Japan . |
| 59-172214 | 9/1984 | Japan . |
| 61-228602 | 10/1986 | Japan . |
| 61-256608 | 11/1986 | Japan . |
| 61-502923 | 11/1986 | Japan . |
| 62-145619 | 6/1987 | Japan . |
| 63-62305 | 3/1988 | Japan . |
| 63-167636 | 11/1988 | Japan . |
| 141203 | 2/1989 | Japan . |
| 1132108 | 5/1989 | Japan . |
| 313709 | 2/1991 | Japan . |
| 320406 | 2/1991 | Japan . |
| 348204 | 5/1991 | Japan . |
| 379406 | 8/1991 | Japan . |
| 625611 | 2/1992 | Japan . |
| 4237313 | 8/1992 | Japan . |
| 4293207 | 10/1992 | Japan . |

*Primary Examiner*—Fritz Fleming

*Attorney, Agent, or Firm*—Sughrue, Mion, Zinn, Macpeak & Seas, PLLC

[57] ABSTRACT

An electromagnetic contactor to which voltage generated through full wave rectification of an alternating current or DC voltage is loaded. The device provides control for a closing operation with a large pulse width according to a set-up frequency and control for maintaining the closed state of the electromagnetic contactor with a small pulse width for executing ON/OFF control. The device comprises a detector for detecting a peak voltage value of the voltage subjected to full wave rectification and an average value or an effective value thereof and a controller for stabilizing the input at a constant level by controlling a pulse width of a frequency set up based on a voltage value detected by the detector.

56 Claims, 10 Drawing Sheets

MOVABLE SECTION DISPLACEMENT DETECTING SECTION
109
120
MC
1
2
3
4
5
6
7
8
9
10
11
DRIVER
DRIVER
E
F
COMPUTING CONTROL CIRCUIT
D
A
B
C
CONSTANT VOLTAGE CIRCUIT
AVERAGE VOLTAGE VALUE DETECTION CIRCUIT
130
140
PEAK VOLTAGE DETECTION CIRCUIT
150
151
SURGE ABSORBING ELEMENT

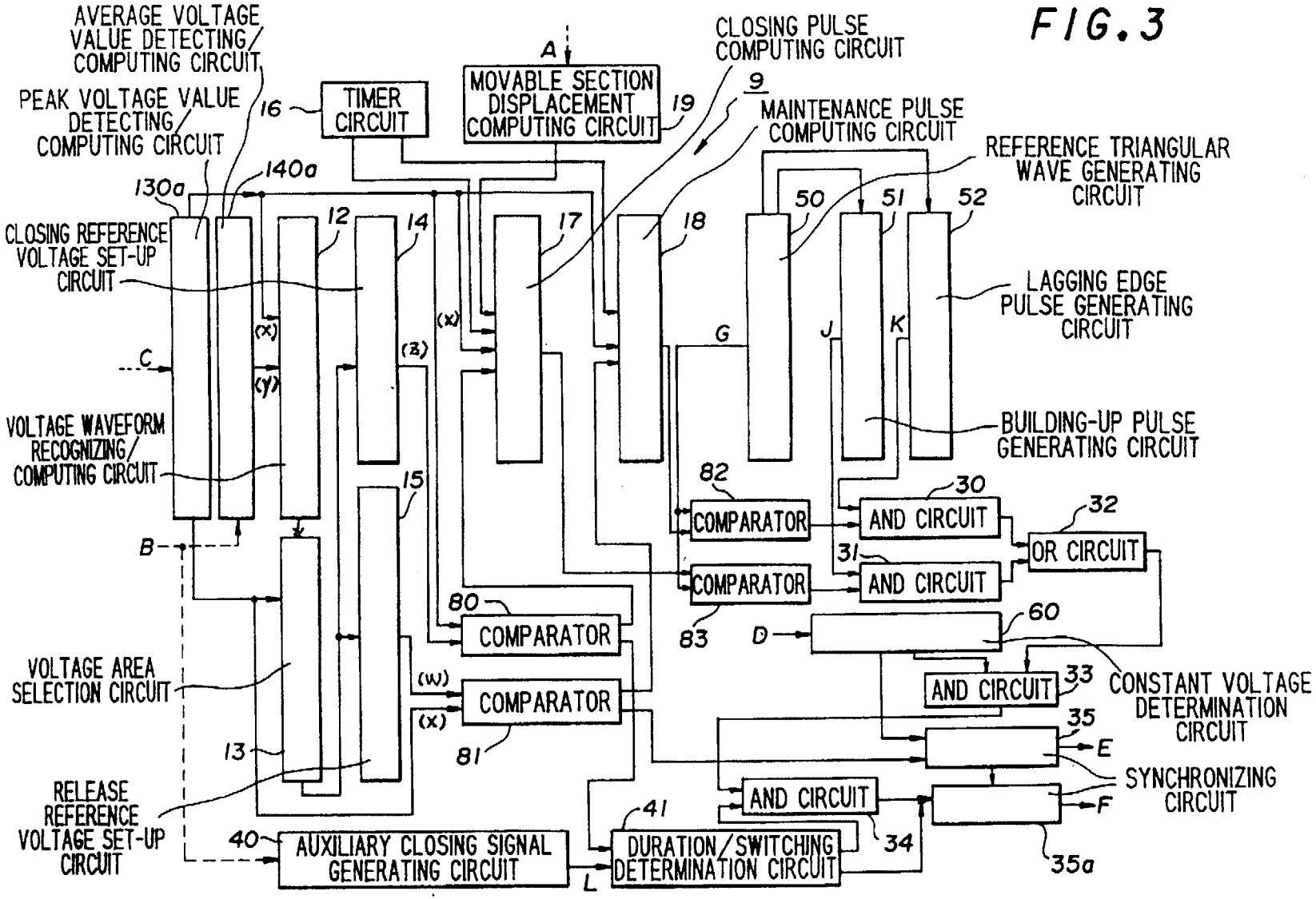
FIG. 3
CLOSING PULSE COMPUTING CIRCUIT
9
MAINTENANCE PULSE COMPUTING CIRCUIT
REFERENCE TRIANGULAR WAVE GENERATING CIRCUIT
LAGGING EDGE PULSE GENERATING CIRCUIT
BUILDING-UP PULSE GENERATING CIRCUIT
OR CIRCUIT
CONSTANT VOLTAGE DETERMINATION CIRCUIT
SYNCHRONIZING CIRCUIT
AND CIRCUIT
COMPARATOR
MOVABLE SECTION DISPLACEMENT COMPUTING CIRCUIT
DURATION/SWITCHING DETERMINATION CIRCUIT
AUXILIARY CLOSING SIGNAL GENERATING CIRCUIT
TIMER CIRCUIT
AVERAGE VOLTAGE VALUE DETECTING/COMPUTING CIRCUIT
PEAK VOLTAGE VALUE DETECTING COMPUTING CIRCUIT
CLOSING REFERENCE VOLTAGE SET-UP CIRCUIT
VOLTAGE WAVEFORM RECOGNIZING/COMPUTING CIRCUIT
VOLTAGE AREA SELECTION CIRCUIT
RELEASE REFERENCE VOLTAGE SET-UP CIRCUIT

CLOSING

MAINTENANCE

ELECTROMAGNETIC CONTACTOR AND A METHOD OF CONTROLLING THE SAME

FIELD OF THE INVENTION

This invention relates to an electromagnetic contactor providing controls for absorption, maintenance, and release with a single phase alternating-current power supply as well as to a method of controlling the same, and especially relates to an electromagnetic contactor providing controls with a large pulse width upon power turn ON by loading a voltage generated through full wave rectification of an alternating current or a direct current voltage and according to the set-up frequency and also providing ON/OFF controls for maintenance with a small pulse width as well as to a method of controlling the same.

BACKGROUND OF THE INVENTION

As a conventional type of system providing ON/OFF controls over coil current in an electromagnetic contactor by subjecting a single phase alternating current to full wave rectification and using a switching element, there are the "coil driving unit for an electromagnetic contactor" disclosed in Japanese Patent Laid-Open Publication No. 132108/1989 and the "coil exciting circuit for an electromagnetic contactor" disclosed in Japanese Patent Laid-Open Publication No. 145619/1987. These have been proposed so that one coil can be used for both 100 V and 200 V, each requiring a different rating of a coil.

FIG. 8 is a block diagram showing general configuration of the "coil driving unit for an electromagnetic contactor" disclosed in Japanese Patent Laid-Open Publication No. 132108/1989, and in this figure an alternating current power supply 201 provides an AC voltage to a direct current input terminal of a full wave rectification circuit 202 when a power switch is ON. An operation coil 203 is excited, for instance, an electromagnetic contactor used in an electromagnetic relay, and a supply voltage, which is a DC output voltage from the full wave rectification circuit 202, is supplied thereto when a field-effect transistor (FET) 204 as a switching element is ON.

Also the supply voltage from rectification circuit 202 is provided to a DC constant voltage circuit 208, which supplies a constant voltage to several components. One component to receive the constant voltage is voltage detection circuit 205, which outputs a detected voltage $V_D$ and a voltage-level establishing signal $S_D$. The constant DC voltage is also supplied to a gain circuit 206, which amplifies the detected voltage $V_D$ by a specified amplification factor and outputs it as a level signal SLa for use in a closing operation. The gain circuit 206 amplifies the detection signal $V_D$ by a higher amplification factor than that described above when a time-up signal $V_T$ is received from a timer circuit 207 and outputs it as a level signal SLb for use in a maintenance operation. With reference to FIGS. 9A and 9B, it can be seen that as the signal $V_S$ is compared to different reference levels of signal Sla and Slb, different output pulses Pa and Pb, respectively, are generated.

In FIG. 8, designated at 208 is a constant voltage circuit which generates DC constant voltage from a supply voltage and at 209 is a reference wave generating circuit, which outputs a triangular wave (a serrated wave $V_s$ for example) as a reference wave by receiving the DC constant voltage. A comparator 210 is operative to compare the serrated wave $V_s$ and the level signal Sla for purposes of a closing operation, and outputs the pulse signal Pa to pulse outputting circuit 211 for the closing operation. The comparator 210 also compares the serrated wave $V_s$ and the level signal Slb for the maintenance operation, and outputs the pulse signal Pb for maintenance. The pulse outputting circuit 211 is operative to output the pulse signal Pa for closing to a field effect transistor (FET) 204 by receiving the voltage-level establishing signal $S_D$ from voltage detecting circuit 205, and to output the pulse signal Pb for maintaining and controlling the FET 204.

FIG. 10 is a wave form diagram showing a wave form in a main portion thereof when 100 V or 200 V is loaded as an input voltage to the "coil exciting circuit" disclosed in Japanese Patent Laid-Open Publication No. 145619/1987. In this figure, the reference character "i" shows an operation of a movable section which is absorbed by a coil, indicating that load of the voltage is complete in a period $t_0$ after start of voltage load. Also the reference character "a" shows a voltage wave form after full wave rectification, while the reference character "e" shows an output wave form after integration of the wave form "a" beginning at the start of period $t_0$. Other waveforms are explained in the above referenced publication, whose teachings are incorporated by reference, but are not relevant to the present invention.

Reference technical documents for this invention other than those described above include Japanese Patent Laid-Open No. 47714/1984 disclosing the "electromagnetic solenoid driving circuit for such devices as a sewing machine driving unit", Japanese Patent Laid-Open Publication No. 502923/1986 disclosing the "electromagnetic coil control unit and electric switching device using the same", Japanese Patent Laid-Open Publication No. 228602/1986 disclosing the "electromagnetic solenoid control unit", Japanese Patent Laid-Open Publication No. 41203/1989 disclosing the "DC-excited type electromagnet device", Japanese Patent Laid-Open Publication No. 293207/1992 disclosing the "electromagnet device", Japanese Patent Laid-Open Publication No. 237313/1992 disclosing the "current control circuit for power supply unit", Japanese Patent Laid-Open Publication No. 62305/1988 disclosing the "coil exciting circuit", Japanese Utility Model Laid-Open Publication No. 167636/1988 disclosing the "relay circuit", Japanese utility Model Laid-Open Publication No. 20406/1991 disclosing the "solenoid driving circuit", Japanese Utility Model Laid-Open Publication No. 79406/1991 disclosing the "coil driving unit for electromagnet", Japanese Utility Model Laid-Open Publication No. 13709/1991 disclosing the "driving circuit for solenoid", Japanese Utility Model Laid-Open Publication No. 48204/1991 disclosing the "solenoid driving unit", Japanese Patent Laid-Open Publication No. 256608/1986 disclosing the "DC electromagnet device", and Japanese Utility Model No. 5611/1987 disclosing the "coil driving circuit for electromagnetic device".

The conventional technology as described above, however, assumes an AC commercial power subjected to full wave rectification, and because of the problems concerning operational compatibility with existing equipment or voltage fluctuation in a battery power supply, it has been difficult to use a coil for AC power as well as for DC power requiring a lower input level for a minimum closing voltage and a release reference voltage as compared to that for AC power. Further description is made for this problem in detail below.

The conventional technology disclosed in Japanese Patent Laid-Open Publication No. 132108/1989 assumes power supply generated through full wave rectification of commercial power supply as described above, the effective voltage area of the prior art-based products is as follows:

In case of AC: Minimum closing voltage, 70–80% E
Release voltage, 40 to 55% E

In case of DC: Minimum closing voltage, 50—50% E
Release voltage, 20 to 30% E (herein, E is a rated voltage for the coil)

and in addition, and disadvantageously a reference for AC operation as well for DC operation cannot be changed.

Also the voltage detecting circuit 205 shown in FIG. 8 is a type based on division of resistance and voltage detection is performed according to a transitional value such as a peak value, so that it is impossible to distinguish AC from DC. In addition, in the conventional technology as described above, a gain for the closing operation is differentiated from that for maintenance. For instance, FIG. 9A shows waveforms relevant to voltages and duties in a closing operation, while FIG. 9B shows waveforms relevant to those in a maintenance operation, and as shown in these figures a lower side of a saw-tooth wave is used in closing, and an upper side thereof is used for maintenance, so that only a narrow area can be used in the vertical direction for each case. In other words, one gain circuit 206 is used by switching between closing and maintenance operations, so that only a narrow area of a saw-tooth wave can be used for generating a pulse for maintenance in the maintenance mode, and it is very difficult to provide minute controls over a coil according to increase of temperature in the coil, which are essential for insuring a long operating life of the coil.

Furthermore as a control pulse is generated by comparing the current voltage to that of a saw-tooth wave, so that an upper limit of a pulse width cannot be specified and also a change of pulse width according to a voltage is only a linear one, and for these reasons it has been difficult to change the pulse width in the form of, for instance, an inverse proportion curve to maintain an input to a coil at a constant level.

In the technology disclosed in Japan Patent Laid-Open Publication No. 145619/1987 described above, a time constant for the integration circuit is larger by several cycles as shown by the waveform "e" in FIG. 10, so that a detected voltage value cannot be used for determination as to whether the reference voltage has been established, or for determination of a power supply wave form. Namely in the conventional technology described above input to a coil is controlled by an integration circuit having a large range according to an effective value of a voltage, so that a coil can be used for AC and DC as well as for a rectangular wave form power supply as far as input is concerned, but there is no way but to depend on voltage detection in determining whether the voltage of a power supply satisfies the requirements such as the minimum closing voltage in an integration circuit having a large time constant. As a result, it has been impossible to switch a reference voltage value between the AC power supply and DC power supply.

In addition, a pulse width for closing changes only according to a voltage, so that it has been impossible to mitigate the physical impact generated at the start of point contact or when a movable iron core collides with a fixed iron core. In particular, it is very difficult to precisely execute minute control of movement according to small differences between input voltages when a coil is used for both 100 V and 200 V, a factor that is detrimental to the operating life of the contacts or the iron core.

SUMMARY OF THE INVENTION

It is an object of the present invention to provide an electromagnetic contactor which can be used for voltage-doubled ratings such as 100 V and 200 V, and which can maintain an input to a coil, control an impact in closing, and provide an absorbing force at a constant level, even under a fluctuating voltage.

It is another object to provide a method of controlling an electromagnetic contactor that is operative as previously specified.

In the electromagnetic contactor and a method of controlling the same according to the present invention, input to a coil is maintained at a constant level by detecting a peak value and an average value or an effective value thereof of a voltage generated through full wave rectification or a DC current with a detector and controlling for a pulse width of a frequency set up according to the detected voltage value, so that the electromagnetic contactor can be used for various types of power supply including a complete direct-current power supply, a power supply subjected to full wave rectification, a power supply subjected to half-wave rectification, and an inverter power supply, and makes it possible to set a reference voltage for each.

In the electromagnetic contactor and a method of controlling the same according to the present invention, input is maintained at a constant level by detecting a peak value and an average value or an effective value thereof of a voltage generated through full wave rectification or a DC current with a detector and controlling an ON time for a pulse width of a frequency set up according to the detected voltage value, it is possible to easily obtain a controlling method applicable to various types of power supply including, in addition to a DC power supply, a complete DC power supply or a power supply subjected to full-wave rectification, a power supply subjected to half-wave rectification, and an invertor power supply.

In the electromagnetic contactor and a method of controlling the same according to the present invention, a switching element connected in parallel to an operating coil is set to an OFF state in an area where a computing controller cannot be driven, so that malfunctions, abnormal operations, and abnormal continuity are eliminated and safety is improved.

In the electromagnetic contactor and a method of controlling the same according to the present invention, an electric current flows in a coil for operating the electromagnetic contactor upon receipt of an auxiliary closing signal during voltage detection, and the coil for the electromagnetic contactor is controlled on the basis of a logical product between the auxiliary closing signal and a control pulse for closing, so that it is possible to execute accurate operations automatically according to the closing signal or at an appropriate timing.

In the electromagnetic contactor and a method of controlling the same according to the present invention, a pulse width that is set up for the closing and maintaining operations is changed, so that it is possible to execute closing without fail and freely reduce an input while the closed state is maintained.

In the electromagnetic contactor and a method of controlling the same according to the present invention, a pulse width for a voltage value decreases in inverse proportion to the voltage value, so that the absorbing force and an input to a coil can be maintained at a constant level, irrespective of the voltage value.

In the electromagnetic contactor and a method of controlling the same according to the present invention, a reference wave having 3 acute angles $\alpha$, $\beta$ and $\gamma$ and also having a specified frequency is generated, a reference pulse for closing or for maintenance is generated according to a building up or a lagging edge of the reference voltage, a pulse is generated by comparing a level of detected voltage value to the reference wave level, and also a control pulse for closing or maintenance, in which a pulse width decreases in association with increase of the detected voltage value is generated according to the logical product of the above two values, so that adjustment of a control pulse width for closing and maintenance is very easy. Namely it is possible to maintain an input to an coil at a constant level as well as to provide minute controls over an alternating power supply.

In the electromagnetic contactor and a method of controlling the same according to the present invention, a reference wave having 3 acute angles α, β, and γ and also having a specified frequency is generated, a reference pulse for closing or for maintenance is generated respectively according to a building up or a lagging edge of the reference voltage, a pulse is generated by comparing a level of detected voltage value to the reference wave level, and also a control pulse for closing or maintenance, in which a pulse width decreases in association with increase of the detected voltage value is generated according to the logical product of the above two values, so that a pulse for closing or for maintenance can easily be set up at a free ratio with one reference wave by changing an angle in building up or a lagging edge thereof and also fine controls over the angle is very easy.

In the electromagnetic contactor and a method of controlling the same according to the present invention, when the electromagnetic contactor is closed, a plurality of minimum operation reference voltage values are set up for starting an operation of closing the electromagnetic contactor by generating a control pulse for closing operation for the first time and a minimum operation reference voltage value is selected according to a peak value and an average value or an effective value of the detected voltage, so that the capability for executing a closing operation at an appropriate voltage can be improved.

In the electromagnetic contactor and a method of controlling the same according to the present invention, a plurality of maximum release reference voltage values for stopping an operation for maintaining the electromagnetic contactor in the closed state according to a control pulse for maintenance for the first time when the electromagnetic contactor is maintained in the closed state and starting release of the electromagnetic contactor, and a maximum release reference voltage value can be selected according to a peak value and an average value or an effective value of the detected voltage, so that the capability for releasing at an appropriate value can be maintained.

In the electromagnetic contactor and a method of controlling the same according to the present invention, a pulse width becomes smaller just before a timing for starting contact specified by a timer when the electromagnetic contactor is closed and the pulse width is returned to the original one just after start of contact, so that an impact in point contact can be reduced, contact bounce can be suppressed, and an operating life of the contact can be maintained for a long time.

In the electromagnetic contactor and a method of controlling the same according to the present invention, when the electromagnetic contactor is closed, the position of the movable section is detected by a movable section displacement detector, the pulse width becomes smaller just before the specified timing for contact and the pulse width is restored to the original large one after start of contact, so that an impact in point contact can be reduced, contact bounce can be suppressed, and the operational life of the contact can be maintained for a long time.

In the electromagnetic contactor and a method of controlling the same according to the present invention, when the electromagnetic contactor is closed, a pulse width becomes smaller just before a timing for collision between the movable iron core and the fixed iron core specified by the timer, and the pulse width is restored to the original large one after collision between the movable iron core and the fixed iron core, so that an impact in collision of the iron cores can be reduced and also the iron cores can be used for a long time.

In the electromagnetic contactor and a method of controlling the same according to the present invention, when the electromagnetic contactor is closed, a position of the movable section is detected by a movable section displacement detector, a pulse width becomes smaller just before collision of the movable iron core with the fixed iron core, and the pulse width is restored to the original large one after collision of the movable iron core with the fixed iron core, so that an impact in collision of the iron cores can be reduced and the iron cores can be used for a long time.

Other objects and features of this invention will become understood from the following description with reference to the accompanying drawings.

BRIEF DESCRIPTION OF THE DRAWINGS

FIG. 3 is a block diagram showing general configuration of the computing control circuit shown in FIG. 2;

DESCRIPTION OF THE PREFERRED EMBODIMENTS

Figure 1:
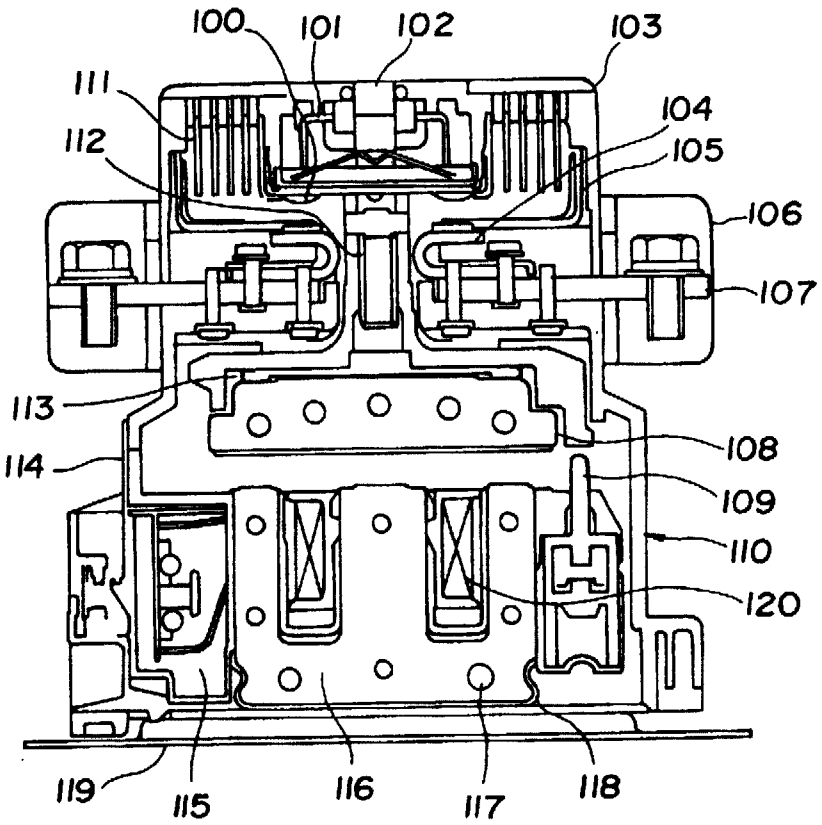
FIG. 1 is a cross sectional view showing general configuration of an electromagnetic contactor.

Description is made hereinafter for embodiments of an electromagnetic contactor and a method of controlling the same according to this invention with reference to the related drawings. FIG. 1 is a cross sectional view showing the configuration of the electromagnetic contactor according to the present invention. In FIG. 1, such components as a driving control section 115 for executing driving control for the electromagnetic contactor, a movable section displacement detecting section 109 for mechanically detecting displacement of the movable section, and an operation coil 120 to generate an absorbing force in a fixed iron core 116 are accommodated in a coil unit 114.

The movable section described above comprises a movable contact 100 with a contact point mounted on an edge surface thereof, and a cross bar 102 on which a contact spring 112 loading a contact pressure to said movable contact 100 and a movable iron core 108 absorbed by a fixed iron core 116 are accommodated and which moves together with the movable iron core 108. When the operation coil is excited upon input from a power supply, the movable iron core 108 is moved into the fixed iron core 116, and the movable contact 100 mounted on the cross bar 102 contacts the fixed contact 104 fixed to the base 110 of the product to establish an electrical contact between the two components. As a result, the electromagnetic contactor is closed and set in the ON state.

In this closed state, the movable section displacement detecting section is mechanically pushed by the movable section, and outputs a contact signal indicating displacement of the movable section or an analog value indicating displacement thereof to the driving control section 115 to give information concerning a position where point contact is started or a position where the iron cores collide into each other. When excitation of the operation coil 120 is released, an urging force between the iron cores disappears, and the movable section is returned to the OFF state shown in FIG. 1 by a return spring not shown herein. Then, the arc generated between the contacts by a communicating plate 101, a grid 111, an arc runner 105, and an arc box 103 rapidly disappear. With this, continuity between contact points is lost. It should be noted that the reference numeral 106 indicates a terminal barrier, 107 indicates a terminal located in the terminal barrier 106, 113 indicates a buffer rubber piece, 116 indicates a fixed iron core, 117 indicates a fixed iron core support pin, 118 indicates a buffer plate spring, and 119 indicates a mounting plate.

Figure 2:
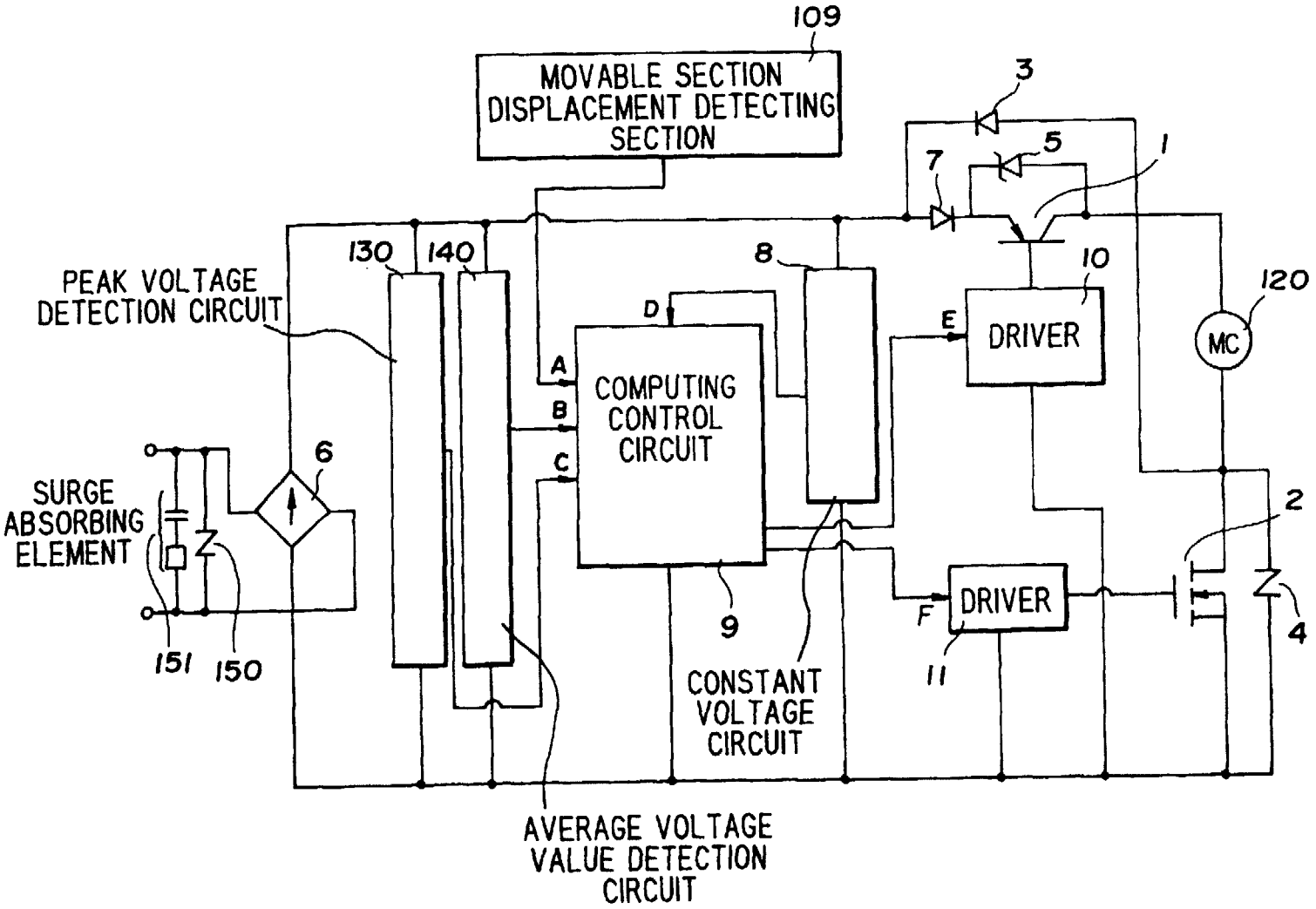
FIG. 2 is a block diagram showing general configuration of a control system for an electromagnetic contactor according to the present invention.

FIG. 2 is an explanatory drawing showing a basic configuration of a driving circuit in the electromagnetic contact according to the present invention. In this figure, designated at 1 is a first switching element (transistor), at 2 a second switching element (field-effect transistor), at 3 a diode for prevention of a counter electromotive force, at 4 a barrister (surge absorbing element) to protect the second switching element, at 5 a Zener diode (surge absorbing element) to protect the first switching element, at 6 a full-wave rectification circuit, at 7 a diode for prevention of reverse current, and at 8 a constant voltage circuit.

Also in this figure, designated at 9 is a computing control circuit which executes various types of computing to control the entire electromagnetic contactor, at 10 a driver to drive the first switching element, at 11 a driver to drive the second switching element 2, at 130 a peak voltage detection circuit, at 140 an average voltage value detection circuit, and at 150 and 151 a surge absorbing element.

Next description is made for operations of the electromagnetic contactor according to the present invention. A power supply for operation of the device is subjected to full wave rectification in the full-wave rectification circuit 6, and the input voltage is loaded onto the operation coil MC 120 via the first switching element 1 and the second switching element 2, all three of which are connected in a series circuit. The first switching element 1 is driven by the driver 10, which is controlled according to the output from the computing control circuit 9, and the second switching element 2 is similarly driven by the driver 11.

When the second switching element is OFF, the counter electromotive force output from the operation coil MC 120 is reflexed by the diode 3. Also the barrister 4 and the Zener diode 5, which are surge absorbing elements, protect the switching elements 1 and 2 respectively, and also function to shorten a release time by consuming energy in the coil when in the released state. The constant voltage circuit 8 supplies a constant voltage to the computing control circuit 9. The computing control circuit 9 receives output A from the movable section displacement detecting section 109, output C from the peak voltage value detecting circuit 130, output B from the average voltage value detecting circuit 140, and output D from the constant voltage circuit 8, executes a specified processing for computing, and provides output E to the driver 10, and output F to the driver 11 as a control signal respectively to control the switching elements 1 and 2.

Figure 4:
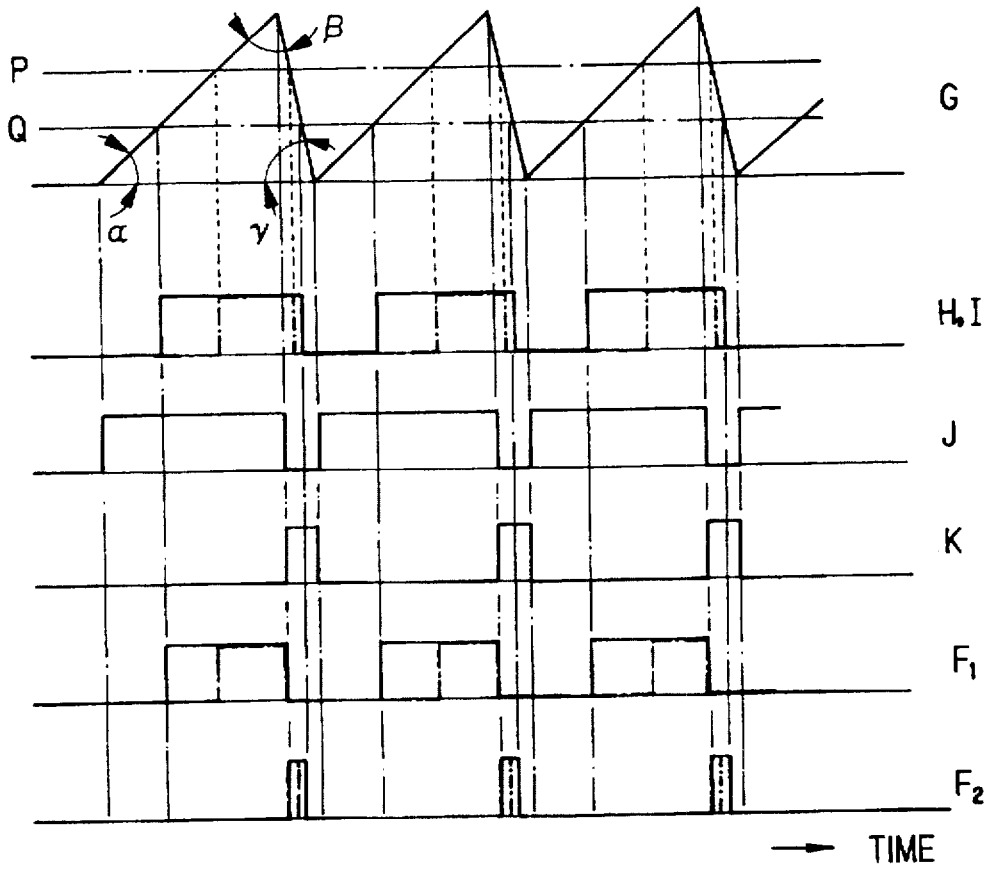
FIG. 4 is a timing chart plotting a state of signal outputted from the computing control unit as a function of time.

Next a detailed description is made for configuration of the computing control circuit 9 as well as for controlling operation of the electromagnetic contactor. FIG. 3 is a block diagram showing an embodiment of the computing control circuit 9, while FIG. 4 is a timing chart showing output signals from each circuit plotted as a function of time. Description is made below for operations and functions of the electromagnetic contactor including load of voltage to the electromagnetic contactor with reference to FIG. 3 and FIG. 4.

In FIG. 3, designated at **130*a* is a peak voltage value detecting/computing circuit, to which a voltage value obtained by dividing a voltage after full rectification from the peak voltage value detecting circuit 130 is continuously input as a monitor value for the transitional voltage value. A peak value for this voltage in each cycle is held and the peak value is output to the voltage waveform recognizing/computing circuit 12. The reference numeral 140*a* indicates an average voltage value detecting/computing circuit, to which a voltage value obtained by dividing a voltage from the average voltage value detecting circuit 140 after full wave rectification thereof is continuously input. The values for each cycle are integrated to obtained the average value, and the average value is output to the voltage wave form recognizing/computing circuit 12**.

The reference numeral 12 indicates a voltage waveform recognizing/computing circuit, which compares output (x) from the peak voltage value detecting/computing circuit **130*a* to output (y) from the average voltage value detecting/computing circuit 140*a***, and if the following condition for example is satisfied;

$$y>0.95\times x,$$

the power supply is regarded as AC power supply, and if the condition is not satisfied, the power supply is regarded as DC power supply, and a different value is output as a signal to a voltage area section circuit 13 in each case respectively.

The reference numeral 13 indicates a voltage area section circuit, to which output from the voltage waveform recognizing/computing circuit 12 and output from the peak voltage value detecting/computing circuit **130*a*** are provided as inputs, and which selects any of the following 4 cases of the voltage area;

(1) 100 V rating AC power supply
(2) 200 V rating AC power supply
(3) 100 V rating DC power supply
(4) 200 V rating DC power supply and supplies output at a different level for each case to the closing reference voltage set-up circuit 14 and a release reference voltage set-up circuit 15.

The reference numeral 14 indicates a closing reference voltage set-up circuit, to which output from the voltage area selecting circuit 13 is provided as an input, and which sets up a closing reference circuit as follows;

In case of (1) above, $\sqrt{2}\times 80$ V

In case of (2) above, $\sqrt{2}\times 160$ V

In case of (3) above, 65 V

In case of (4) above, 130 V and provide a different output for each case to a comparator 80.

The reference numeral 15 indicates a release reference voltage set-up circuit, to which output from the voltage area selecting circuit 13 is provided as input and which sets up a reference voltage for each of the following cases;

In case of (1) above, $\sqrt{2}\times 40$ V

In case of (2) above, $\sqrt{2}\times 80$ V

In case of (3) above, 20 V

In case of (4) above, 40 V and provided a different output in each case to a comparator 81.

The reference numeral 16 indicates a timer circuit, to which voltage from an operating power supply (not shown) is loaded, and which outputs a signal for switching a pulse computing circuit (described hereinafter) from a closing operation to a maintenance operation after the supply of an output from the constant voltage circuit 8 is enabled. Thus, a closing operation can be conducted without fail according to a voltage that is higher than a closing reference value over a period of time (refer to T1 in FIG. 6) and is supplied to a closing pulse computing circuit 17 and a maintenance pulse computing circuit 18.

Figure 5A:
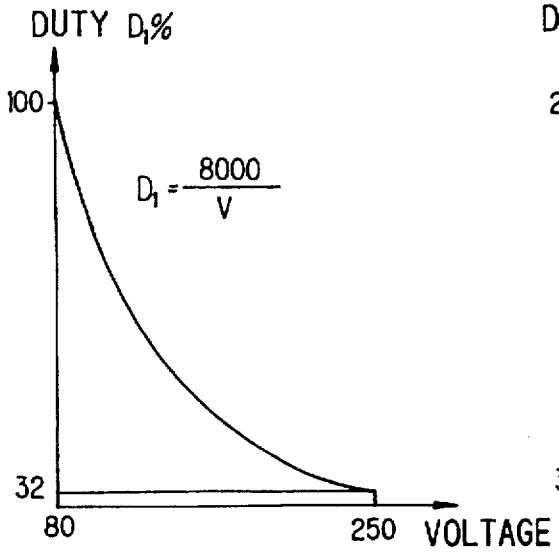
FIGS. 5A and 5B are graphs showing the relation between a pulse generated under voltages for closing and maintenance and the duty.

The reference numeral 17 indicates a closing pulse computing circuit, to which an output from each of the timer circuit 16, the comparator 80 described hereinafter, the peak voltage value detecting/computing circuit 130*a*, and a movable section displacement computing circuit 19 is provided as inputs, respectively. The closing pulse computing circuit 17 outputs a level signal to a comparator 83, when a signal indicating a timing just before output from the timer circuit 16 is switched to maintenance on the basis that the comparator 80 indicates that closing is allowable. As a result, when it is determined from a level of voltage output from the peak voltage value detecting/computing circuit 130*a* that, for instance, a closing reference voltage set up by the closing reference voltage set-up circuit 14 for the voltage areas (1) and (2) above selected in the voltage area selection circuit 13 is $\sqrt{2}\times 80$ V, a pulse width continuously changes from the 100 V class to the 200 V class, as in the closing operation shown in FIG. 5A. In this case, the contactor is automatically adjusted for an absorbing force of the electromagnetic force to be stabilized at a constant level irrespective of voltage loaded thereto (V shown in FIG. 5A is an effective value).

Also, the closing pulse computing circuit 17 outputs a high level signal (H) for suppressing the output of pulses from a comparator 83 (to be described hereinafter) to an AND circuit 31 when an output from the timer circuit 16 is switched to a maintenance operation state. Furthermore, if a signal is output from the movable section displacement computing circuit 19 (to be described hereinafter), before the start of point contact and before collision of the iron cores, and is input into the closing pulse computing circuit 17, the pulse width of a signal output from the closing pulse computing circuit 17 is reduced by around 30%. Also, the pulse width is restored to the previous level when a signal indicating the start of point contact or collision of the iron cores is received.

Figure 5B:
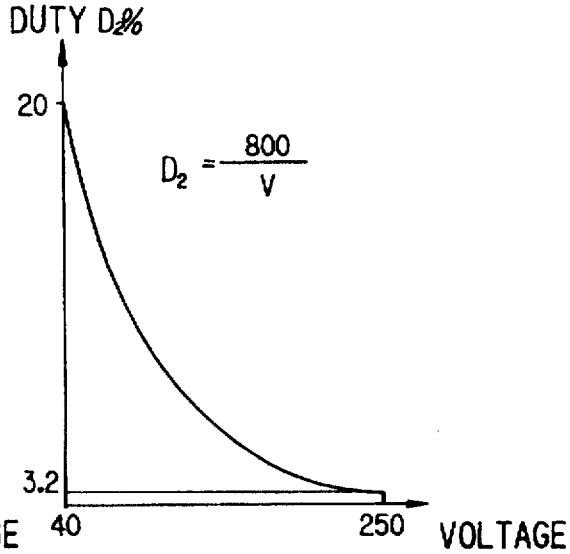

The reference numeral 18 indicates a maintenance pulse computing circuit, into which an output from each of the timer circuit 16, the comparator 81 (to be described hereinafter), and the peak voltage value detecting/computing circuit 130*a* is supplied as an input. The maintenance pulse computing circuit 18 generates a signal indicating that an output from the timer circuit 16 has been switched to indicate a maintenance operation, if a signal is also outputted from the comparator 81 that indicates that the maintenance operation is to be continued. The comparator 81 outputs a level signal so that, when a level of output voltage from the peak voltage value detecting/computing circuit 130*a* indicates that a release reference voltage set up by the release reference voltage set-up circuit for both the voltage areas 1) and 2) above set up by the voltage area selecting circuit 13 is $\sqrt{2}\times 40$ V, the pulse width is continuously changed from the 100 V class to the 200 V class as shown in FIG. 5B and is automatically adjusted for input to the electromagnetic contactor. In this manner, an absorbing force is provided that is stabilized at a constant level irrespective of the loaded voltage (V in FIG. 5B is an effective value). Also the maintenance pulse computing circuit 18 outputs a high level signal (I) inhibiting output of pulses from the comparator 82 (to be described hereinafter) to the AND circuit 30.

The reference numeral 19 is a movable section displacement computing circuit, which provides the above-described output concerning point contact or collision of the iron cores, according to a signal generated by detecting a position of the movable section with such a device as an optical sensor, to the closing pulse computing circuit 17.

The reference numeral 30 indicates an AND circuit for the maintenance operation, which provides the AND processing of outputs from the lagging edge pulse generating circuit 52 (to be described hereinafter) and that from the comparator 82 (to be described hereinafter) and outputs pulses indicated by $F_2$ in FIG. 4. The reference numeral 31 indicates an AND circuit for the closing operation, which provides the AND processing of outputs from the building up pulse generating circuit 51 (to be described hereinafter) and the comparator 83 (to be described hereinafter) and outputs pulses indicated by $F_1$ in FIG. 4. The reference numeral 32 indicates and OR circuit, which provides an OR processing between the output from the AND circuit 30 and the AND circuit 31 and outputs the pulse to the AND circuit 33 (to be described hereinafter).

The reference numeral 33 indicates an AND circuit, which provides AND processing of outputs from a constant voltage determination circuit 60 (to be described hereinafter) and that from the OR circuit 32 and provides the output pulse to the AND circuit 34 (also described hereinafter). The reference numeral 34 indicates an AND circuit, which provides AND processing of outputs from the AND circuit 33 and that from a duration/switch determination circuit when output therefrom has been switched to the AND circuit 34 side and provides the output F to excite the electromagnetic contactor. The reference numeral 35 indicates a synchronizing circuit which synchronizes output E to output F so that the switching elements 1 and 2 are turned ON or OFF simultaneously.

The reference numeral 40 indicates an auxiliary closing signal generating circuit, which outputs 100% duty pulses upon loading of an operational voltage to the electromagnetic contactor, namely input of output C. The reference numeral 41 indicates a duration/switching determination circuit, to which an output from the comparator 80 as well as an output from the auxiliary closing signal generating circuit 40 are provided as an input, and which outputs a signal inhibiting signal pulse to excite the electromagnetic contactor via the AND circuit 34 when output from the comparator 80 is a signal indicating the necessity to terminate closing. Then the signal directly output as output F is cut. Also before the output of a result of a determination by the comparator 80, an output is not provided to the AND circuit 34, and pulses generated by the auxiliary closing signal generating circuit 40 are directly used as output F.

The reference numeral 50 indicates a reference triangular wave generating circuit, which outputs a reference triangular wave having a frequency of around 20 Khz such as output G in FIG. 4. The reference numeral 51 indicates a building-up pulse generating circuit, which outputs pulse having a width of building-up section such as that of output J in FIG. 4 according to output from the reference triangular wave generating circuit 50. The reference numeral 52 indicates a lagging edge pulse generating circuit, which outputs have a width of lagging edge section such as that of output K in FIG. 4 according to output from the reference triangular wave generating circuit 50.

The reference numeral 60 indicates a constant voltage determination circuit, which outputs a signal inhibiting pulse output from the AND circuit 33 or, in other words, a signal causing the electromagnetic contactor to turn OFF to the AND circuit 33, when output D from the constant voltage circuit 8 is in a voltage area inappropriate to drive MC stably.

Also the reference numeral 80 indicates a comparator for a closing operation, which compares output (z) from the closing reference voltage set-up circuit 14 to output (x) from the peak voltage value detecting/computing circuit 130, allows closing if the following condition is satisfied;

$$x \geqq z$$

inhibits closing if the condition is not satisfied, and outputs the signal to the closing pulse computing circuit 17. The reference numeral 81 indicates a comparator for a maintenance operation, which compares output (w) from the release reference voltage set-up circuit 15 to output (x) from the peak voltage value detecting/computing circuit 130*a*, allows release (reduces a current flowing in the electromagnetic contactor to zero and releases the electromagnetic contactor) if the following condition is satisfied:

$$x < w,$$

specifies duration of the closed state if the condition above is not satisfied, and outputs the signal to the maintenance pulse computing circuit 18.

The reference numeral 82 indicates a comparator, which compares the output from the maintenance pulse computing circuit 18 (level P) to that from the reference triangular wave generating circuit 50 and outputs the pulse indicated by I in FIG. 4. The reference numeral 83 indicates a comparator for closing, which compares the output from the closing pulse computing circuit 17 (level Q) to that from the reference triangular wave generating circuit 50 and outputs the pulse indicated by H in FIG. 4.

Next description is made for concrete operations of the electromagnetic contactor according to the present invention. When an operational voltage is applied to the electromagnetic contactor, for instance a 100% duty signal, namely a step signal is output from the auxiliary closing signal generating circuit 40. The auxiliary closing signal raises a coil current to a specified level according to a coil time constant to compensate a time delay required for detecting an average value or an effective value in the voltage detection circuit for the purpose to control time for closing in an electromagnetic contactor.

The duration/switching determination circuit 41 directly provides output F until voltage detection, causing a flow of an auxiliary closing current in the operation coil MC 120, and stops the output of the auxiliary closing signal when it is judged by the comparator 80 after voltage detection that the operation voltage is lower than the closing reference voltage and closing should be inhibited. Alternatively, the circuit 33 provides output F via the AND circuit 34 in place of directly providing output F. (In such case, another signal for turning OFF the second switching element 2 is being provided as input to the AND circuit 34, so that output F turns OFF the second switching element 2). The circuit arrangement provides output F via the AND circuit 34 in place of directly providing the auxiliary closing signal as output F when it is determined by the comparator 80 after voltage detection that the operational voltage is higher than the closing reference voltage and closing should be executed. In such case, another signal to control ON/OFF pulse for the second switching element is being provided as input to the AND circuit 34, so that output F controls ON/OFF pulse for the first switching element 1.

In an unstable voltage zone from the first application of an operational voltage to the electromagnetic contactor until the start of supply of an appropriate voltage large enough to drive the computing control circuit 9 from the constant voltage circuit 8, the second switching element 2 is turned OFF. In generating a signal for turning OFF the second switching element 2, an input is received from the constant voltage determination circuit 60 to the AND circuit 33. At the same time also the first switching element 1 is turned OFF, so that a signal to turn OFF the switching element 1 will outputted in synchronism to output F. Also simultaneously, when a voltage enough to drive the computing control circuit 9 is supplied from the constant voltage circuit 8, output E changes to a signal to turn ON the first switching element 1.

Figure 7:
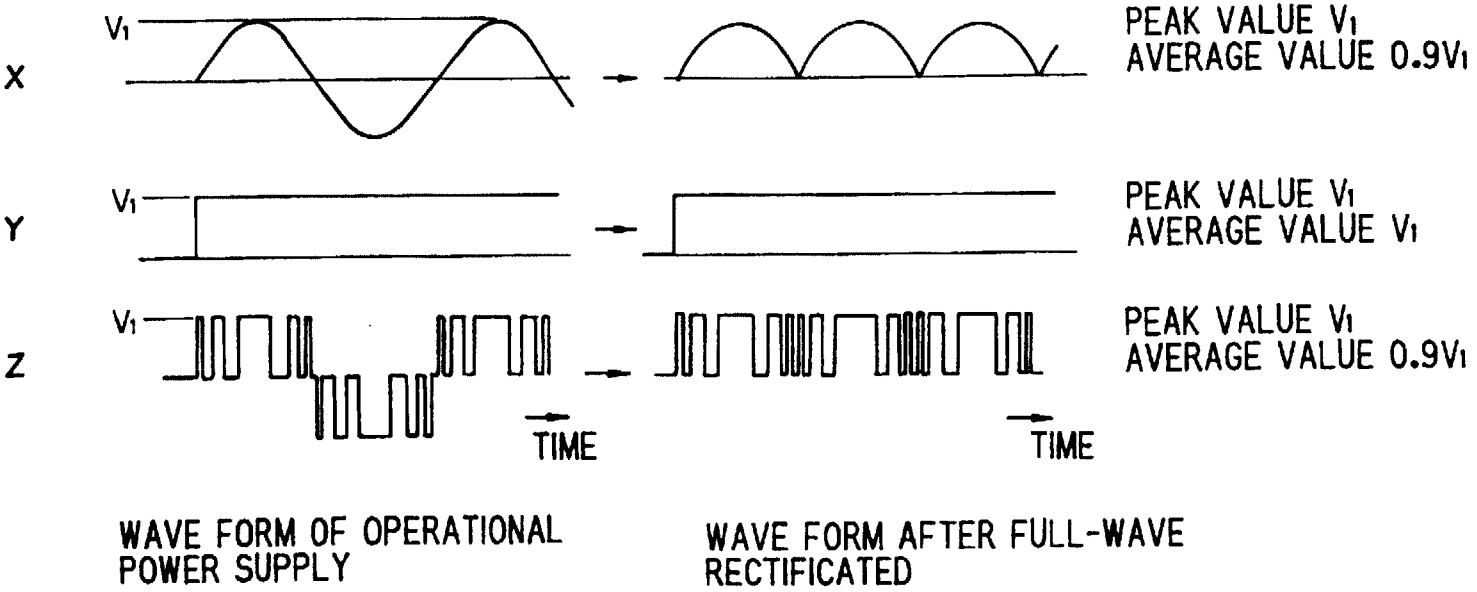
FIG. 7 shows a wave form of operating power supply available according to the present invention and a wave form after full wave rectification of the power supply.
Figure 8:
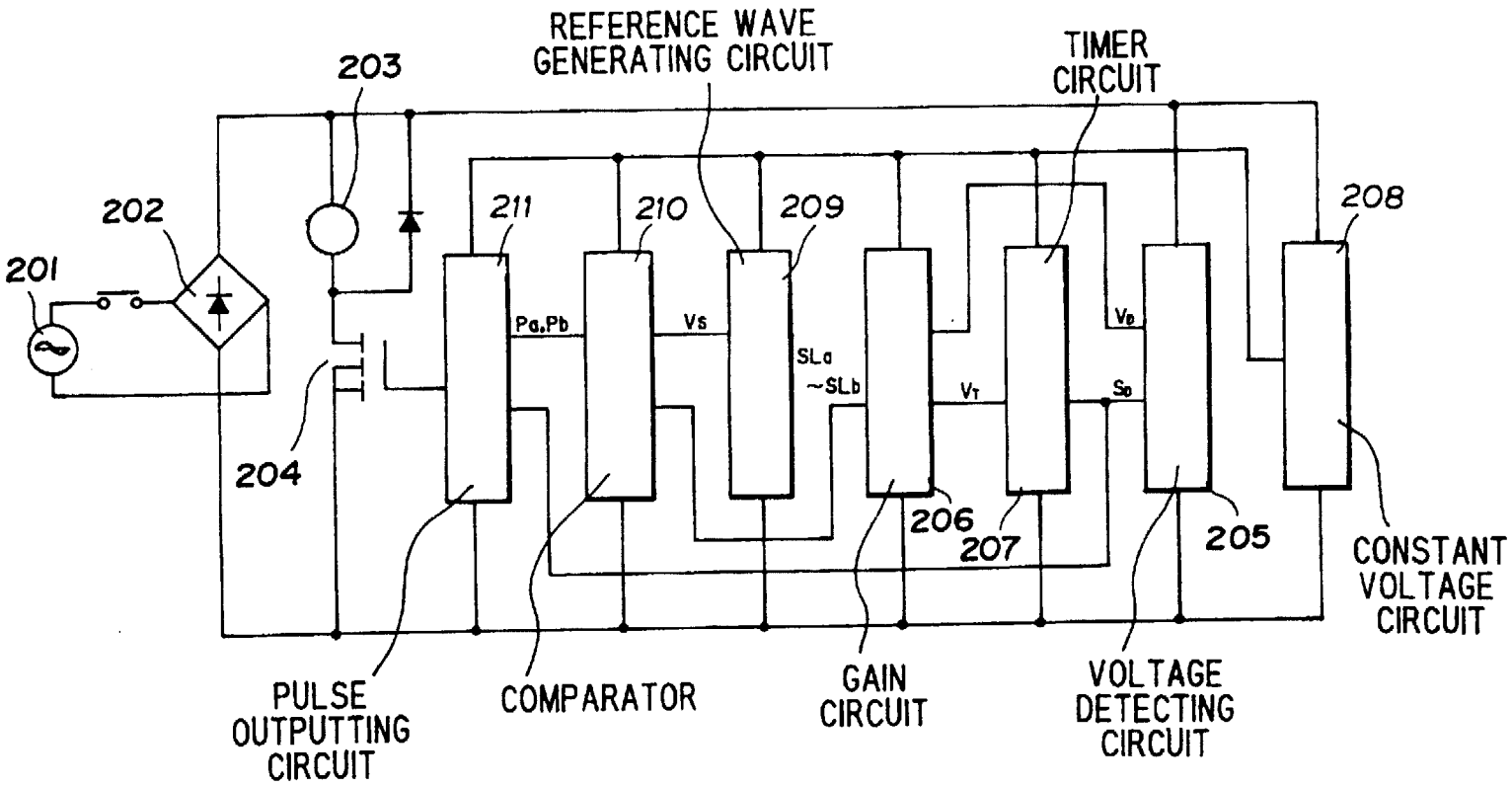
FIG. 8 PRIOR ART
FIG. 8 is a block diagram showing general configuration of a conventional type of electromagnetic contactor.
Figure 9A:
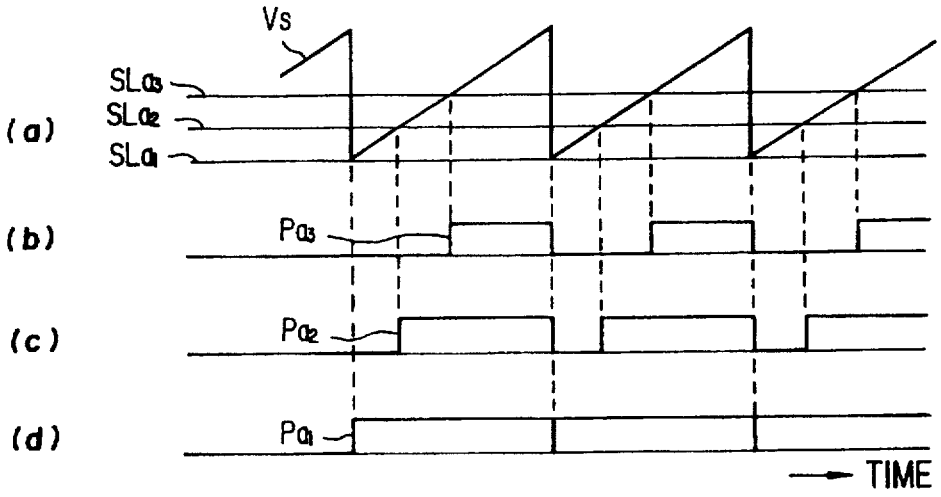
FIG. 9A PRIOR ART
FIGS. 9A and 9B are timing chart showing a state of output signal from the electromagnetic contactor shown in FIG. 8.
Figure 9B:
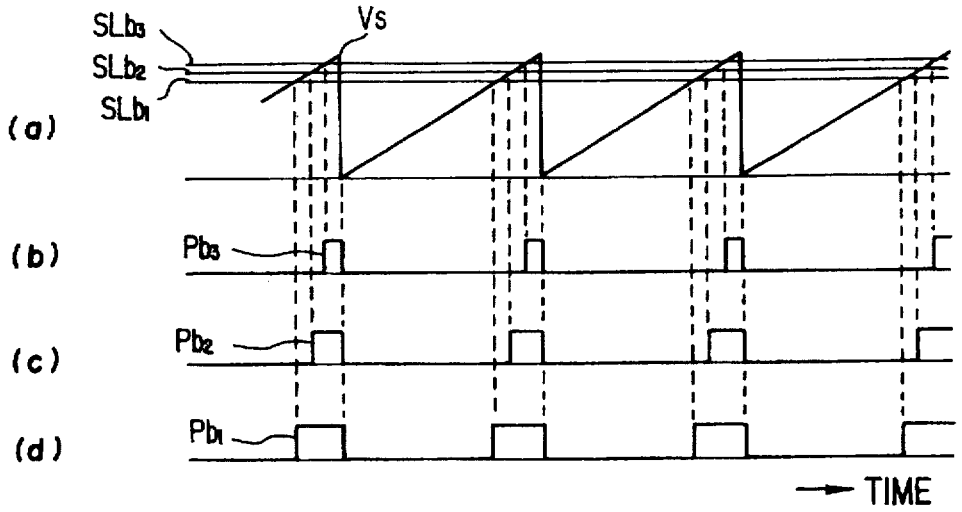
FIG. 9B PRIOR ART
Figure 10:
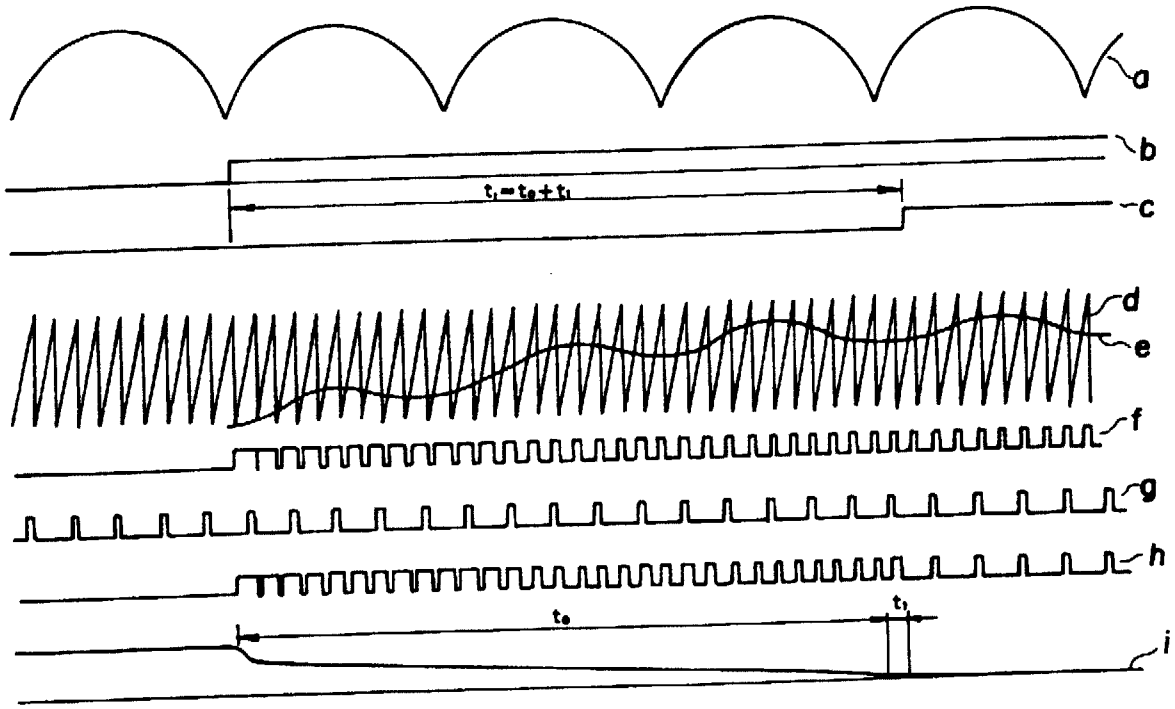
FIG. 10 PRIOR ART
FIG. 10 is a timing chart showing a state of output signal from another conventional type of electromagnetic contactor.

When output C from the peak voltage value detection circuit 130 and output B from the average voltage value detection circuit 140 are provided as inputs, a voltage peak value and an average value thereof are computed by the computing circuits 130*a* and 140*a* respectively, and with this operation it is determined by the voltage waveform recognizing/computing circuit 12 that the current power supply is an AC power supply or a DC one. For instance, in case of an AC power supply having a commercial frequency as indicated by X in FIG. 7, the average value after full wave rectification is 0.9 of the peak value, and in case of a complete DC current as indicated by Y in the figure, the average value is completely the same as the peak value, so that it is possible to discriminate a power supply on the basis of various conditions as described above. Also in case of an inverter power supply as indicated by Z in the figure, no problem occurs.

Then in case of an electromagnetic contactor available for both 100 V class power supply and 200 V class power supply, if it is necessary to differentiate a reference voltage for closing or release in 100 V class power supply from that in 200 V class power supply, determination as to whether the current power supply is of 100 V class or 200 V class is executed by the voltage area selection circuit 13, and with this operation a reference voltage for closing or that for release is set up.

To the closing pulse computing circuit 17 are provided input signals indicating a result of a comparison between the reference voltage for closing and the detected voltage (from comparator 80), a signal for detected voltage, a signal for reducing input to a coil before start of point contact and before collision of iron cores from the movable section displacement computing circuit 19, and an output from the timer circuit 16 for switching the pulse computing circuit (i.e., from 17 to 18) from closing to maintenance in accordance with a time limit (T1 in FIG. 6) for completion of closing after start of load of operational voltage. Then, as shown by the graph for closing in FIG. 5A, a pulse width continuously changes from 100 V class to 200 V class and an output level is adjusted so that the absorbing force is stabilized at a constant level irrespective of loaded voltage.

Description is made for this operation with reference to FIG. 4. Output G for a reference triangular wave having a frequency of around 20 Khz is checked in the comparator 83, and level P or level Q is changed so that output H becomes a large duty as indicated by a solid line in FIG. 4 in closing if the loaded voltage is lower than the reference voltage or becomes a relatively smaller duty as indicated by an alternate long and short dash line in FIG. 4 if the loaded voltage is higher than the reference voltage, and also so that F1, which becomes F in closing, will follow the curve as shown in FIG. 5A.

Figure 6:
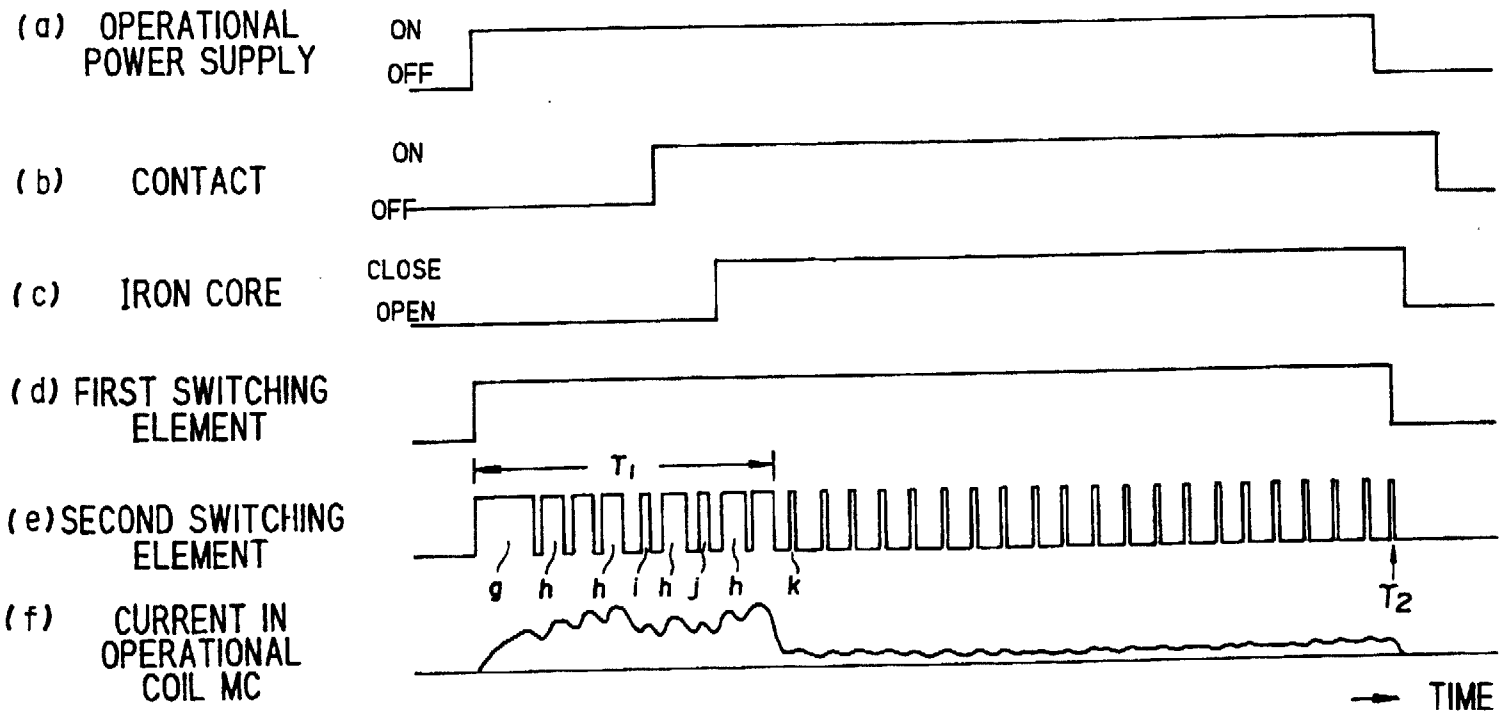
FIG. 6 is a timing chart showing the relation between an opening or closing operation of the electromagnetic contactor according to this invention and control of the electromagnetic contactor.

If a signal, indicating that point contact has not been started yet or iron cores have not collided against each other, is inputted from the movable section displacement computing circuit 19, the level P or Q is dropped to around 30% (points i and j in waveform (e) of FIG. 6), and the level is restored to the original state after start of point contact or collision of the iron cores (points h in waveform (e) of FIG. 6). With this feature, it is possible to minimize an impact in point contact or collision of iron cores as well as to suppress bounce of the movable section. However, if it is determined depending on a result of comparison between the reference voltage for closing and the detected voltage that the operational voltage is lower than the reference voltage for closing and closing should be inhibited, the level P or Q becomes higher than output G of the reference triangular wave and F becomes a signal for turning OFF the second switching element 2.

Also as indicated by waveforms J and K in FIG. 4, pulses in waveform J having a width of building up time of the reference triangular wave are generated by the building-up pulse generating circuit 51 and pulses or waveform K having a lagging edge time width of the reference triangular wave are generated by the lagging edge pulse generating circuit 52. When it is determined by the comparator 80 that the operational voltage exceeds the reference voltage for closing and closing should be executed, the level P or Q from the maintenance pulse computing circuit 18 becomes larger than output G of the reference triangular wave according to the output from the timer circuit 16. As a result, output I is not provided as shown in FIG. 4, output A and output J from the AND circuit 31 becomes output F, and pulse output F1 shown in FIG. 4 is provided.

To the maintenance pulse computing circuit 18 are provided as inputs a signal indicating a result of comparison between the reference voltage for release and the detected voltage (from comparator 81), a detected voltage signal, output from the timer circuit 16 switching the pulse computing circuit (from circuit 17 to 18) from closing to maintenance when a specified period from start of load of voltage until completion of closing. As a result, the pulse Width continuously changes from 100 V class to 200 V class as shown by the graph for the maintenance mode in FIG. 5B, and the output level is adjusted to the absorbing force, namely a power consumption in the coil is maintained at a constant level irrespective of loaded voltage. Generally a power consumption in the coil in closing may be around one tenth of that in maintenance.

Next a description is made for this operation. Output G of the reference triangular wave is checked in the comparator 82, and output I develops a relatively large duty in maintenance, when loaded voltage is low, although smaller as compared to that in closing as indicated by a solid line in FIG. 4. Output I develops a very small duty as indicated by an alternate long and short dash line in FIG. 4 when the loaded voltage is high to change the level P or Q so that the signal F in maintenance becomes as shown in FIG. 5B.

However, if it is determined from a result of comparison between the reference voltage for maintenance and the detected voltage that the operational voltage is lower than the reference voltage for release and that release should be executed, the level P or Q becomes higher than output G of the reference triangular wave to turn OFF the second switching element 2, and F becomes a signal to turn OFF the second switching element 2. At this point in time, the output E and output F are provided from the synchronizing circuit 35 to simultaneously turn OFF the second switching element 2 and the first switching element 1.

Also as indicated by waveforms J and K in FIG. 4, pulses in waveform J having a width of building up time of the reference triangular wave are generated by the building-up pulse generating circuit 51 and pulses in waveform K having a lagging edge time width of the reference triangular wave are generated by the lagging edge pulse generating circuit 52. When it is determined by the comparator 81 that operational voltage exceeds the reference voltage for maintenance and the closed state should be maintained, the level P or Q from the maintenance pulse computing circuit 17 becomes lower than the output G of the reference triangular wave according to the output from the timer circuit 16, so that output H is provided as shown in FIG. 4, output I and output K from the AND circuit 31 becomes output F, and pulse output F2 shown in FIG. 4 is provided.

As described above, it is easy to realize control over different pulse widths of the second switching element 2 one for closing and another for maintenance with one reference triangular wave. Also, it is possible to reduce power consumption in a coil for a maintenance operation to one tenth of that in closing by setting a ratio of a width of time zone of first transition of the reference triangular wave vs a width of time zone for a lagging edge of the reference triangular wave to 10:1. Also it is fully possible in an operational area of ICs or microcomputers to use one electromagnetic contactor for both 100 V power supply and 200 V power supply by setting the minimum reference voltage for closing to a duty of 10% (V=80 V in FIG. 5A) and also setting the maximum reference voltage for release to a duty of 20% (V=40 V in FIG. 5B), and also it is possible to maintain a coil input or an absorbing force at a constant value irrespective of loaded voltage. Furthermore the above-described voltage control is continuously executed during operation, so the voltage is maintained at a constant level without being affected by fluctuation of operational voltage.

Next description is made for operation of the electromagnetic contactor, operation of the switching elements, and change of current in the operation coil MC 120, especially for a single opening/closing operation as an example with reference to FIG. 6. In this figure, the sign (a) indicates ON/OFF state of an operational power supply, (b) indicates ON/OFF state of a contact in the electromagnetic contactor, (c) indicates open/closed state of the movable iron core 108 of the electromagnetic contactor, (d) and (e) indicate ON/OFF states of the first switching element and the second switching element respectively, and (f) indicates a timing chart for change of a current in the operational coil MC 120.

With reference to waveform (e) of FIG. 6, at first, when the operational power supply is turned ON, the first switching element is turned ON, and the auxiliary closing signal g is output from the second switching element 2. Then, a closing signal h corresponding to a voltage is output after voltage detection. Then, a signal i with a reduced pulse width according to displacement of the movable section detected just before start of point contact is output, the pulse width being returned to the original value after start of point contact, a signal j with a reduced pulse width according to displacement of the movable section detected just before collision of the iron cores is output, the pulse width being returned to the original value after collision of the iron cores, and when a period after start of closing in which closing can be completed without fail has passed, a maintenance pulse signal k is output. At the start of point contact or at collision of iron cores, the coil current becomes smaller as indicated by waveform (f) in FIG. 6 to mitigate an impact caused by the point contact or the collision, and then the current is restored to the original level soon, so that bouncing can be prevented.

Also as a duty for waveform K in FIG. 4 is very small, a coil input for maintenance becomes very small as indicated by waveform (f) in FIG. 6, so that rise of coil temperature can be suppressed. In addition as indicated by the waveform (f), operation of the electromagnetic contactor is smoothed and also noise caused by the iron cores can be prevented. If the operational voltage is set to the OFF state, the voltage becomes lower than the reference voltage for release; consequently, the first switching element 1 and the second switching element 2 are simultaneously turned OFF by the synchronizing circuit 35. As the two switching elements are set to OFF state simultaneously, the first switching element 1 and the second switching element 2 can share resistance against voltage. With this arrangement, cheap products can be used for that purpose.

Furthermore, more accurate control as compared to that in the embodiment described above can be realized by dividing an operational voltage into fine voltage areas and setting a pattern of reference voltages and pulse widths for each voltage area minutely. Also it is possible to prevent malfunctions such as erroneous contact of contacting points during operation for voltage detection.

Although detection of displacement of the movable section is executed mechanically in the above embodiment, detection of movable section's displacement may be performed by using a non-contact magnetic sensor or optical sensor, or by using a timer which can make an estimation for timing purposes.

As described above, the electromagnetic contactor and a method of controlling the same according to the present invention, maintains input to a coil at a constant level by detecting a peak value and an average value or an effective value of a voltage generated through full wave rectification thereof by a detector. Using those values, controls may be provided over ON time having a pulse width of a frequency set up according to the detected voltage value, so that the electromagnetic contactor can be used for various types of power supplies including, in addition to an AC power supply, a complete DC power supply, a power supply subjected to full wave rectification, and an invertor power supply. Also, it is possible to set up a reference voltage suited to each type of power supply.

In the electromagnetic contactor and a method of controlling the same according to the present invention, the input is maintained at a constant level by detecting a peak value of a voltage subjected to full wave rectification or a DC voltage and an average value or an effective value thereof and controlling ON time having a pulse width of a frequency set up according to the detected voltage value, so that it is possible to obtain a controlling method applicable to various types of power supplies including, in addition to an AC power supply, a complete DC current, a power supply subjected to full wave rectification, a power supply subjected to half-wave rectification, and an invertor power supply.

In the electromagnetic contactor and a method of controlling the same according to the present invention, switching elements connected in series to an operational coil are set to OFF state in an area where a computing controller can not be driven, so that malfunctions, abnormal functions, and continuity in an abnormal state are eliminated and the safety can be raised.

In the electromagnetic contactor and a method of controlling the same according to the present invention, a current is flown in an operational coil for the electromagnetic contactor with an auxiliary closing signal during voltage detection, and the coil for electromagnetic contactor is controlled according to a logical product of control pulse for the auxiliary closing signals for closing and maintenance or by switching after voltage detection, so that a switching operation can accurately be executed automatically according to the auxiliary closing signal or without losing a timing.

In the electromagnetic contactor and a method of controlling the same according to the present invention, a pulse width to be set for closing and for maintaining the closed state of the electromagnetic contactor is changed, so that closing can be executed without fail and input during maintenance can freely be reduced.

In the electromagnetic contactor and a method of controlling the same according to the present invention, a pulse width for a voltage value becomes smaller in inverse proportion to the voltage value, so that coil input and an absorbing force can be maintained at a constant value irrespective of the voltage value.

In the electromagnetic contactor and a method of controlling the same according to the present invention, a reference wave having three acute angles $\alpha$, $\beta$, and $\gamma$ each corresponding to a set-up frequency is generated, a reference pulse for closing or for maintenance is generated according to building up or lagging edge of the reference wave, the reference pulses being generated by comparing a level of a detected voltage value to the level of reference wave, and a control pulse is generated for closing or maintenance with a pulse width decreasing in association with increase of the detected voltage value according to a logical product of the reference pulses, so that a control pulse width can easily be adjusted for closing and for maintenance. Namely input to a coil can be maintained at a constant level precisely, and also it is possible to provide minute controls over operation thereof as well as over an AC power supply.

In the electromagnetic contactor and a method of controlling the same according to the present invention, a reference wave having three acute angles $\alpha$, $\beta$, and $\gamma$ each corresponding to a set-up frequency is generated, a reference pulse for closing or for maintenance is generated according to building up or lagging edge of the reference wave, the reference pulses being generated by comparing a level of a detected voltage value to the level of the reference wave, and a control pulse is generated for closing or maintenance with a pulse width decreasing in association with increase of the detected voltage value according to a logical product of the pulses, so that pulses for closing and maintenance can easily be generated at a free width ratio by changing angles for building up or lagging edge with one reference wave and also fine adjustment of the angles above can easily be carried out.

In the electromagnetic contactor and a method of controlling the same according to the present invention, when the electromagnetic contactor is closed, a plurality of minimum reference voltage values each for generating control pulse for closing for the first time when the electromagnetic contactor is closed and starting operation for closing the electromagnetic contactor are set up, and the minimum operating reference voltage value is selected by a peak value of detected voltage and an average value or an effective value thereof, so that the capability for closing under an appropriate voltage can be improved.

In the electromagnetic contactor and a method of controlling the same according to the present invention, a plurality of maximum release reference voltage values each for stopping operation for maintaining the closed state of the electromagnetic contactor according to control pulse for maintenance for the first time when the electromagnetic constant is to be maintained in the closed state and then starting an operation for releasing the electromagnetic contactor, and the maximum release reference voltage value is selected according to a peak value of detected voltage and an average value or an effective value thereof, and for this reason the capability for releasing under an appropriate voltage can be improved.

In the electromagnetic contactor and a method of controlling the same according to the present invention, when the electromagnetic contactor is to be closed, control is executed so that the pulse width becomes smaller just before a timing for starting point contact set up by a timer and the pulse width is restored to the original level just after start of point contact, and for this reason an impact generated in point contact can be reduced, pouncing of contacting points can be suppressed, and the operational life of contact can be maintained for a long time.

In the electromagnetic contactor and a method of controlling the same according to the present invention, when the electromagnetic contactor is closed, a position of the movable section is detected by the movable section displacement detector, and control is executed to that a pulse width becomes smaller just before a timing for starting contact and the pulse width is restored to the original level again just after start of point contact, and for this reason an impact in point contact can be reduced, bouncing of contacting points can be suppressed, and an operational life of the contact can be maintained for a long time.

In the electromagnetic contactor and a method of controlling the same according to the present invention, when the electromagnetic contactor is closed, control is executed so that a pulse width becomes smaller just before a timing set up by a timer for collision between the movable iron core and the fixed core and the pulse width is restored to the original level just after the collision, and for this reason an impact generated in collision between the iron cores can be reduced and an operational life of the iron cores can be maintained for a long time.

In the electromagnetic contactor and a method of controlling the same according to the present invention, when the electromagnetic contactor is closed, control is executed so that a position of the movable section is detected by the movable section displacement detector, a pulse width becomes smaller just before collision of the movable iron core and the fixed iron core and the pulse width is restored to the original level just after the collision between the movable iron core and the fixed iron core, and for this reason an impact generated in collision of iron cores can be mitigated and an operational life of the iron cores can be maintained for a long time.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An electromagnetic contactor, to which an input voltage is loaded and having a coil, comprising:

detector means for detecting a peak voltage value of said input voltage and for detecting an average value of said input voltage, wherein said input voltage is one of a full wave rectified alternating current and a DC voltage, switching means, responsive to an operating signal, for controlling operation of said electromagnetic contactor; and a controller for generating said operating signal and for stabilizing input power supplied to said coil at a constant level by controlling a pulse width of said operating signal based on said peak voltage value and said average value of said input voltage detected by said detector means.

2. The electromagnetic contactor according to claim 1, wherein said controller is arranged to differentiate when said pulse width is set up for implementing a closed state by closing said electromagnetic contactor and when said pulse width is set up for maintaining said closed state.

3. The electromagnetic contactor according to claim 1, wherein said pulse width decreases in inverse proportion to said peak voltage value and said average value of said input voltage.

4. The electromagnetic contactor according to claim 1, further comprising:

means for generating a reference wave comprising three acute angles each corresponding to a respective frequency, means for generating a first reference pulse for implementing said closed state, means for generating a second reference pulse for maintaining said closed state of said electromagnetic contactor, said first reference pulse and said second reference pulse being generated according to a building up and a lagging edge of said reference wave and being generated according to a result of a comparison of said said peak voltage value and said average value of said input voltage detected by said detector means with said reference wave, and means for generating control pulses for closing and maintaining said closed state of said electromagnetic contactor according to a decreasing function that is associated with an increase of said peak voltage value.

5. The electromagnetic contactor according to claim 1, further comprising:

means for generating a reference wave that comprises three acute angles each corresponding to a respective frequency, means for generating a first reference pulse for closing said electromagnetic contactor according to a building up of said reference wave, means for generating a second reference pulse for maintaining said closed state of said electromagnetic contactor according to a lagging edge of said reference wave, said first reference reference pulse and said second reference pulse being generated according to a comparison of said peak voltage value and said average value of said input voltage with said reference wave, and means for generating a control pulse for controlling one of closing and maintaining of said closed state of said electromagnetic contactor according to a function that is decreasing in accordance with increases of said peak voltage value.

6. The electromagnetic contactor according to claim 1, further comprising:

means for providing a plurality of minimum operation reference voltage values, each for generating a control pulse for effecting a closing operation of said electromagnetic contactor when said electromagnetic contactor is to be closed, to start an operation for closing said electromagnetic contactor, one of said minimum operation reference voltage values being selected according to said peak voltage value and said average value.

7. The electromagnetic contactor according to claim 6, further comprising voltage determining means for determining whether said input voltage is said full wave rectification alternating current and when said input voltage is said DC current; and outputting a signal indicating a detected input voltage.

8. The electromagnetic contactor according to claim 7, wherein said means for providing said plurality of said minimum operation reference voltage values is responsive to said signal output by said voltage determining means, and wherein said minimum operation voltage value is selected in accordance with said signal.

9. The electromagnetic contactor according to claim 1, further comprising:

means for selecting a maximum release reference voltage value from among a plurality of maximum release reference voltage values, each for stopping an operation for maintaining said closed state of said electromagnetic contactor when said electromagnetic contactor is to be maintained in said closed state to start release of said electromagnetic contactor, said maximum release reference voltage value being selected according to one of said peak voltage value and said average value of said input voltage.

10. The electromagnetic contactor according to claim 9, further comprising voltage determining means for determining whether said input voltage is said full wave rectification alternating current and when said input voltage is said DC current; and outputting a signal indicating a detected input voltage.

11. The electromagnetic contactor according to claim 10, wherein said means for providing said plurality of said maximum release operation reference voltage values is responsive to said signal output by said voltage determining means, and wherein said maximum release operation voltage value is selected in accordance with said signal.

12. The electromagnetic contactor according to claim 1, further comprising:

timer means for determining a starting point of contact for closing said electromagnetic contactor wherein said pulse width becomes smaller than an original level just before said starting point of contact, and said pulse width is restored to the original level just after said starting point of contact.

13. The electromagnetic contactor according to claim 1, wherein said electromagnetic contactor comprises:

a movable section, and a movable section displacement detector which detects, when said electromagnetic contactor is in a state of being closed, a position of said movable section, wherein said pulse width of said operating signal becomes smaller just before said starting point of contact and said pulse width is restored to an original level just after said starting point of contact.

14. The electromagnetic contactor according to claim 1, wherein said electromagnetic contactor comprises:

a movable iron core, a fixed iron core, and a timer, wherein when said electromagnetic contactor is in a state of being closed, said pulse width of said operating signal becomes smaller than an original pulse width just before collision of said movable iron core and said fixed iron core and said pulse width is restored to said original pulse width just after collision of said movable iron core and said fixed iron core.

15. The electromagnetic contactor according to claim 1, wherein said electromagnetic contactor comprises:

a movable section having a movable iron core, a fixed iron core, a movable section displacement detecting means and a timer, and wherein when said electromagnetic contactor is in a state of being closed, a position of said movable section is detected by said movable section displacement detecting means and wherein said controller is arranged so that said pulse width becomes smaller than an original pulse width just before collision of said movable iron core and said fixed iron core, and said pulse width is restored to said original pulse width just after collision of said movable iron core and said fixed iron core.

16. A method of controlling an electromagnetic contactor, to which an input voltage is loaded, comprising the steps of:

detecting a peak voltage value of said input voltage, said input voltage being one of a full wave rectification of an alternating current and a DC voltage;

generating an operating signal based upon said peak voltage value;

stabilizing input power, supplied to said electromagnetic contactor, at a constant level in accordance with said operating signal;

wherein a closing operation is performed when said operating signal has a first pulse width, and wherein a closed state of said electromagnetic contactor is maintained when said operating signal has a second pulse width; and controlling ON time of said electromagnetic contactor based on said peak voltage value.

17. The method according to claim 16, further comprising the step of differentiating said first pulse width for closing said electromagnetic contactor from said second pulse width for maintaining said closed state of said electromagnetic contactor, wherein said second pulse width is smaller than said first pulse width.

18. The method according to claim 16, wherein a pulse width for said peak voltage value decreases in inverse proportion to said input voltage.

19. The method according to claim 16, further comprising the steps of:

generating a reference wave having three acute angles each corresponding to a frequency, generating reference pulses for closing and for maintaining said closed state of said electromagnetic contactor according to a building up and lagging edge of said reference wave, said step of generating said reference pulses comprising the step of comparing said peak voltage value and said reference wave, and generating control pulses for closing and maintaining said closed state of said electromagnetic contactor.

20. The method according to claim 16, further comprising the steps of:

generating a reference wave having three acute angles each corresponding to a respective frequency, generating a first reference pulse and a second reference pulse for respectively closing and for maintaining said closed state of said electromagnetic contactor according to a building up and lagging edge of said reference wave, respectively, said step of generating said first and second reference pulses comprising the step of comparing said peak voltage value and said reference wave, and generating control pulses for closing maintaining said closed state of said electromagnetic contactor.

21. The method according to claim 16, further comprising the steps of:

generating a plurality of minimum operation reference voltage values, each for generating a control pulse for closing said electromagnetic contactor, to start the operation for closing said electromagnetic contactor, and selecting one of said minimum operation reference voltage values according to said peak voltage value and an average value of said input voltage.

22. The method according to claim 21, further comprising the steps of:

detecting whether said input voltage is a full wave rectification alternating current and when said input voltage is a DC current; and outputting a signal indicating a detected input voltage.

23. The method according to claim 22, wherein said step of providing a plurality of said minimum operation reference voltage values comprises providing said minimum operation reference voltage values in accordance with said signal indicating said detected input voltage, wherein said minimum operation voltage value is selected in accordance with said signal.

24. The method according to claim 16, further comprising the steps of:

generating a plurality of maximum release reference voltage values, each for stopping an operation for maintaining said closed state of said electromagnetic contactor when said electromagnetic contactor is to be maintained in said closed state, to start release of said electromagnetic contactor, and selecting one of said maximum release reference voltage values according to said peak voltage value and an average value of said input voltage.

25. The electromagnetic contactor according to claim 24, further comprising the steps of detecting whether said input voltage is a full wave rectification alternating current and when said input voltage is a DC current; and outputting a signal indicating a detected input voltage.

26. The method according to claim 25, wherein said step of providing a plurality of said maximum release operation reference voltage values comprises providing said maximum release operation reference voltage values in accordance with said signal indicating said detected input voltage, wherein said maximum release operation voltage value is selected in accordance with said signal.

27. The method according to claim 16, further comprising the steps of:

generating said operating signal wherein said first pulse width is reduced from an original pulse width just before a time, set by said timer, for starting a point of contact for initiating closure of said electromagnetic contactor, and restoring said first pulse width to said original pulse width just after starting of said point of contact.

28. The method according to claim 16, further comprising the steps of:

detecting a position of a movable section by a movable section displacement detector when a closing operation of said electromagnetic contactor is initiated, reducing said pulse width from an original pulse width just before a time for starting contact, and restoring said pulse width to said original pulse width just after said starting of contact.

29. The method according to claim 16, further comprising the steps of:

reducing said first pulse width from an original pulse width value, just before a time, set by a timer, for collision of said movable iron core and said fixed iron core, and restoring said first pulse width to said original pulse width just after collision of said movable iron core and said fixed iron core.

30. The method according to claim 16, further comprising the steps of:

detecting a position of a movable section, reducing said first pulse width from an original pulse width value, just before a time for collision of said movable iron core and said fixed iron core, and restoring said first pulse width to said original pulse width just after collision of said movable iron core and said fixed iron core.

31. A method of controlling an electromagnetic contactor to which an input voltage is loaded, comprising the steps of:

detecting a peak voltage value of said input voltage;

generating an operating signal in accordance with said peak voltage value, for closing said electromagnetic contactor, having a first pulse width;

reducing said first pulse width of said operating signal to a second pulse width for maintaining said closed state of said electromagnetic contactor to perform ON/OFF control of said electromagnetic contactor, and setting switching elements, connected in series to an operational coil, to an OFF state when said input voltage is not sufficient to drive said electromagnetic contactor.

32. The method according to claim 31, further comprising the step of differentiating said first pulse width for closing said electromagnetic contactor from said second pulse width for maintaining said closed state of said electromagnetic contactor.

33. The method according to claim 31, wherein said first pulse width and said second pulse width decreases in inverse proportion to said input voltage.

34. The method according to claim 31, further comprising the steps of:

generating a reference wave having three acute angles each corresponding to a frequency, generating references pulses for respectively closing said electromagnetic contactor and for maintaining said closed state of said electromagnetic contactor according to a building up and lagging edge of said reference wave, respectively, wherein said step of generating reference pulses comprises the step of comparing a peak voltage value of said input signal and said reference wave, and generating control pulses for respectively closing said electromagnetic contactor and maintaining said closed state of said electromagnetic contactor.

35. The method according to claim 31, further comprising the steps of:

generating a reference wave having three acute angles each corresponding to a frequency, generating a first reference pulse and a second reference pulse for respectively closing said electromagnetic contactor and for maintaining said closed state of said electromagnetic controller according to a building up and lagging edge of said reference wave, respectively, wherein said step of generating said first and second reference pulses comprises the step of comparing a peak voltage value of said input signal and said reference wave, and generating control pulses for closing said electromagnetic contactor and maintaining said closed state of said electromagnetic contactor.

36. The method according to claim 31, further comprising the steps of:

generating a plurality of minimum operation reference voltage values, each for generating a control pulse for closing said electromagnetic contactor, to start the operation for closing said electromagnetic contactor, and selecting one of said minimum operation reference voltage values according to a peak value of said input voltage and an average value of said input voltage.

37. The method according to claim 36, further comprising the steps of detecting whether said input voltage is a full wave rectification alternating current and when said input voltage is a DC current; and outputting a signal indicating a detected input voltage.

38. The method according to claim 37, wherein said step of providing a plurality of said minimum operation reference voltage values comprises providing said minimum operation reference voltage values in accordance with said signal indicating said detected input voltage, wherein said minimum release operation voltage value is selected in accordance with said signal.

39. The method according to claim 31, further comprising the steps of:

generating a plurality of maximum release reference voltage values, each for stopping an operation for maintaining said closed state of said electromagnetic contactor according to control pulses for maintenance when said electromagnetic contactor is to be maintained in said closed state, to start release of said electromagnetic contactor, and selecting one of said maximum release reference voltage values according to a peak value of said input voltage and an average value of said input voltage.

40. The method according to claim 39, further comprising the steps of detecting whether said input voltage is a full wave rectification alternating current and when said input voltage is a DC current; and outputting a signal indicating a detected input voltage.

41. The method according to claim 40, wherein said step of providing a plurality of said maximum release operation reference voltage values comprises providing said maximum release operation reference voltage values in accordance with said signal indicating said detected input voltage, wherein said maximum release operation voltage value is selected in accordance with said signal.

42. The method according to claim 31, further comprising the steps of:

reducing said first pulse width from an original pulse width, just before a time set by a timer for starting contact for closing said electromagnetic contactor, and restoring said first pulse width to said original pulse width just after said starting of contact.

43. The method according to claim 31, further comprising the steps of:

detecting a position of a movable section by a movable section displacement detector, reducing said first pulse width from an original pulse width, just before a time for starting contact for closing said electromagnetic contactor, and restoring said first pulse width to said original pulse width just after said start of contact.

44. The method according to claim 31, further comprising the steps of:

reducing said first pulse width from an original pulse width, just before a time set by a timer for collision of said movable iron core and said fixed iron core, and restoring said first pulse width to said original pulse width just after collision of said movable iron core and said fixed iron core.

45. The method according to claim 31, further comprising the steps of:

detecting a position of a movable section, reducing said first pulse width from an original pulse width, just before a time for collision of said movable iron core and said fixed iron core, and restoring said first pulse width to said original pulse width just after collision of said movable iron core and said fixed iron core.

46. A method of controlling an electromagnetic contactor having a movable section having a movable iron core, a fixed iron core, and a timer, said electromagnetic contactor being operable in at least a closing state and a maintaining state for ON/OFF control, said method comprising the steps of:

generating an input voltage through one of full wave rectification of an alternating current and a DC voltage, controlling said closing state with an operating signal, determined in accordance with a peak voltage value of said input voltage and supplied to switching means, having a first pulse width;

controlling said maintaining state with said operating signal having a second pulse width, which is smaller than said first pulse width, for maintaining said closing state of said electromagnetic contactor, generating control pulses for obtaining said closing state for the first time when a peak value of said input voltage exceeds a preset minimum operation reference voltage value to start a closing operation, generating an auxiliary closing signal for flowing a current in an operation coil in said electromagnetic contactor during detection of said peak value of said input voltage, and controlling said operation coil in said electromagnetic contactor according to one of a logical product of said control pulses, said auxiliary closing signal and a switching command.

47. The method according to claim 46, further comprising the step of differentiating said first pulse width for closing said electromagnetic contactor from said second pulse width for maintaining said closed state of said electromagnetic contactor.

48. The method according to claim 46, wherein said first pulse width and said second pulse width for said operating signal decreases in inverse proportion to said input voltage.

49. The method according to claim 46, further comprising the steps of:

generating a reference wave having three acute angles each corresponding to a frequency, generating references pulses for respectively closing said electromagnetic contactor and for maintaining said closed state of said electromagnetic contactor according to a building up and lagging edge of said reference wave, respectively, wherein said step of generating reference pulses comprises the step of comparing a peak voltage value of said input voltage and said reference wave, and generating control pulses for respectively closing said electromagnetic contactor and maintaining said closed state of said electromagnetic contactor.

50. The method according to claim 46, further comprising the steps of:

generating a reference wave having three acute angles each corresponding to a frequency, generating a first reference pulse and a second reference pulse for respectively closing said electromagnetic contactor and for maintaining said closed state of said electromagnetic controller according to a building up and lagging edge of said reference wave, respectively, wherein said step of generating said first and second reference pulses comprises the step of comparing a peak voltage value of said input voltage and said reference wave, and generating control pulses for closing said electromagnetic contactor and maintaining said closed state of said electromagnetic contactor.

51. The method according to claim 46, further comprising the steps of:

generating a plurality of minimum operation reference voltage values, each for generating a control pulse for closing said electromagnetic contactor, to start the operation for closing said electromagnetic contactor, and selecting one of said minimum operation reference voltage values according to a peak value of said input voltage and an average value of said input voltage.

52. The method according to claim 46, further comprising the steps of:

generating a plurality of maximum release reference voltage values, each for stopping an operation for maintaining said closed state of said electromagnetic contactor according to control pulses for maintenance when said electromagnetic contactor is to be maintained in said closed state, to start release of said electromagnetic contactor, and selecting one of said maximum release reference voltage values according to a peak value of said input voltage and an average value of said input voltage.

53. The method according to claim 46, further comprising the steps of:

reducing said first pulse width from an original pulse width, just before a time set by a timer for starting contact for closing said electromagnetic contactor, and restoring said first pulse width to said original pulse width just after said starting of contact.

54. The method according to claim 46, further comprising the steps of:

detecting a position of a movable section by a movable section displacement detector, reducing said first pulse width from an original pulse width, just before a time for starting contact for closing said electromagnetic contactor and restoring said first pulse width to said original pulse width just after said start of contact.

55. The method according to claim 46, further comprising the steps of:

reducing said first pulse width from an original pulse width, just before a time set by a timer for collision of said movable iron core and said fixed iron core, and restoring said first pulse width to original pulse width just after collision of said movable iron core and said fixed iron core.

56. The method according to claim 46, further comprising the steps of:

detecting a position of a movable section, reducing said first pulse width from an original pulse width, just before a time set by a timer for collision of said movable iron core and said fixed iron core, and restoring said first pulse width to said original pulse width just after collision of said movable iron core and said fixed iron core.

* * * * *